US005704732A

United States Patent [19]

Horton, III

[11] Patent Number: 5,704,732

[45] Date of Patent: Jan. 6, 1998

[54] DEEP WATER PILING AND METHOD OF INSTALLING OR REMOVING

[75] Inventor: Edward E. Horton, III, Rancho Palos Verdes, Calif.

[73] Assignee: Deep Oil Technology Incorporated, Houston, Tex.

[21] Appl. No.: 564,829

[22] Filed: Nov. 29, 1995

[51] Int. Cl.[6] ..... E02D 7/20

[52] U.S. Cl. ..... 405/228; 405/224; 405/232; 114/296

[58] Field of Search ..... 405/228, 224, 405/244, 195.1, 232; 114/296

[56] References Cited

U.S. PATENT DOCUMENTS

| | | | |
|---|---|---|---|
| 3,411,473 | 11/1968 | Mott et al. | 114/206 |
| 3,496,900 | 2/1970 | Mott et al. | 114/206 |
| 3,817,040 | 6/1974 | Stevens | 405/228 |
| 4,045,969 | 9/1977 | Jansz | 405/228 |
| 4,257,721 | 3/1981 | Haynes | 114/296 X |
| 4,318,641 | 3/1982 | Hogervorst | 405/224 |
| 4,432,671 | 2/1984 | Westra et al. | 114/296 X |
| 4,572,304 | 2/1986 | Mahar et al. | 114/296 X |
| 4,575,282 | 3/1986 | Pardue, Sr. et al. | 405/228 |
| 4,619,218 | 10/1986 | Kenny | 405/228 |

FOREIGN PATENT DOCUMENTS

| | | | |
|---|---|---|---|
| 306904 | 7/1918 | Germany | 405/244 |
| 149886 | 9/1983 | Japan | 114/296 |

*Primary Examiner*—Tamara L. Graysay
*Assistant Examiner*—Frederick L. Lagman
*Attorney, Agent, or Firm*—Robert J. Edwards; D. Neil LaHaye

[57] ABSTRACT

A deep water pile and installation and removal method that eliminates the need for underwater hammers or pile drivers. The pile is a hollow tube that is open at the lower end and provided with a fitting at the upper end for attachment to a lowering pipe. The fitting at the upper end also for fluid communication between the lowering pipe and the pile. Injecting air into the lowering pipe draws water from the lowering pipe and pile. This creates a hydrostatic pressure differential whereby the greater pressure on the outside of the pile head forces the pile into the sea floor. Removal of the pile may be accomplished by injecting high pressure water into the pile through the pile head. The high pressure water injection aids in overcoming the hydrostatic pressure on the outside of the pile head.

2 Claims, 5 Drawing Sheets

DEEP WATER PILING AND METHOD OF INSTALLING OR REMOVING

BACKGROUND OF THE INVENTION

1. Field of the Invention

The invention is generally related to offshore drilling and more particularly to the installation or removal of deep water pilings in the sea floor that are used for mooring floating structures in place.

2. General Background

In the offshore drilling industry, floating structures such as tension leg platforms and deep draft caissons are being used in water depths of five thousand feet and deeper. These structures are held in place by a plurality of mooring lines that have one end attached to the floating structure and the opposite end attached to anchors or pilings that are embedded in the sea floor and spaced laterally from the floating structure. The pilings must be designed and installed at a suitable depth so as to be able to withstand the bending moment and upward pulling forces that are caused by the taut mooring lines. Installation of pilings in deep water for mooring floating structures in place presents challenges not normally encountered in shallow water.

SUMMARY OF THE INVENTION

What is provided is a deep water piling and method for installing or removing a deep water piling that eliminates the need for underwater hammers or pile drivers. The pile is a hollow tube that is open at the lower end and provided with a fitting at the upper end for attachment to a lowering pipe. The fitting at the upper end also provides for fluid communication between the pile and the lowering pipe. Injecting air into the lowering pipe draws water upward from the lowering pipe and pile. This creates a hydrostatic pressure differential whereby the greater pressure on the outside of the pile head forces the pile into the sea floor. Removal of the pile may be accomplished by attaching the lowering pipe to the pile and injecting high pressure water into the pile through the pile head. The high pressure water injection aids in overcoming the hydrostatic pressure on the outside of the pile head as well as soil friction with the pile.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
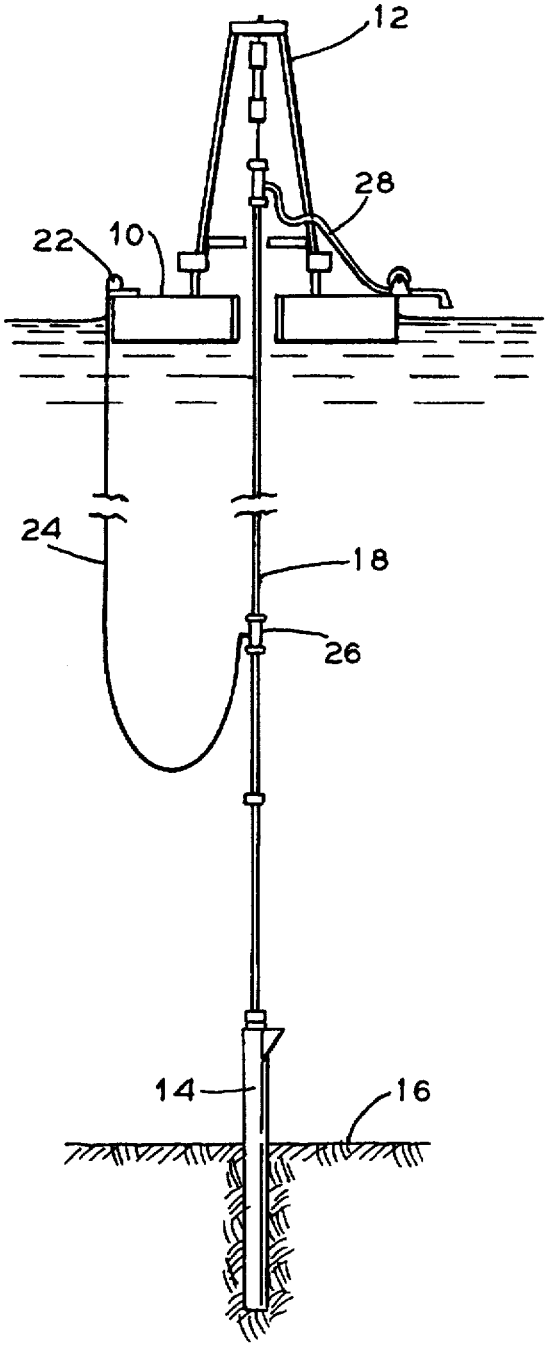
FIG. 1 is an elevation view that illustrates the installation of a pile.
Figure 2:
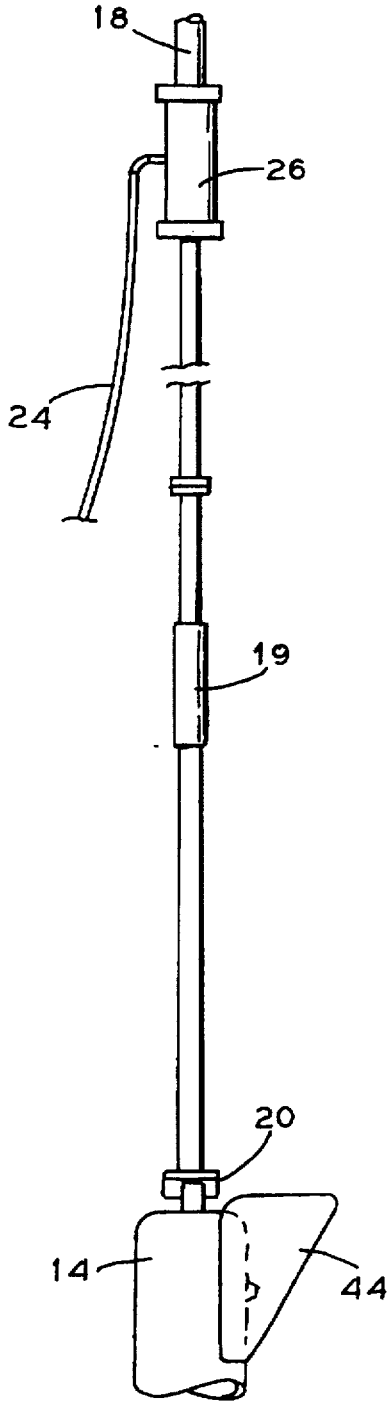
FIG. 2 is a detail view of a portion of the lowering pipe and pile.

Referring to the drawings, FIG. 1 generally illustrates the installation of a pile. Surface vessel 10 has a derrick 12 that is used to lower the suction pile 14 to the sea floor 16. Lowering pipe 18, sometimes referred to as drill pipe, is attached to the upper end of suction pile 14 by means of a marine connector 20 as seen in FIG. 2. Marine connector 20 allows for remotely activated attachment or detachment between suction pile 14 and lowering pipe 18. Telescoping joint 19 acts as a buffer to prevent damage and absorb the energy of any vertical movements resulting from wave action on surface vessel 10. Spool 22 stores air injection line 24 which is connected to air injection inlet 26 on lowering pipe 18. Compressed air is provided from a source not shown on surface vessel 10 and injected into lowering pipe 18. As air is injected into lowering pipe 18 at high pressure, the air moves up lowering pipe 18, drawing water up with the air. Fluid line 28 is in fluid communication with and attached to the upper end of lowering pipe 18. Water drawn up from the lowering pipe 18 and pile 14 flows into fluid line 28 and is discharged over the side of surface vessel 10. As water is removed from the lowering pipe 18 and pile 14, a pressure differential is created where the pressure on the inside of the suction pile 14 drops below the ambient hydrostatic pressure outside of the suction pile 14. The greater exterior hydrostatic pressure causes downward pressure on the suction pile 14 and pushes the pile into the sea floor.

Figure 5:
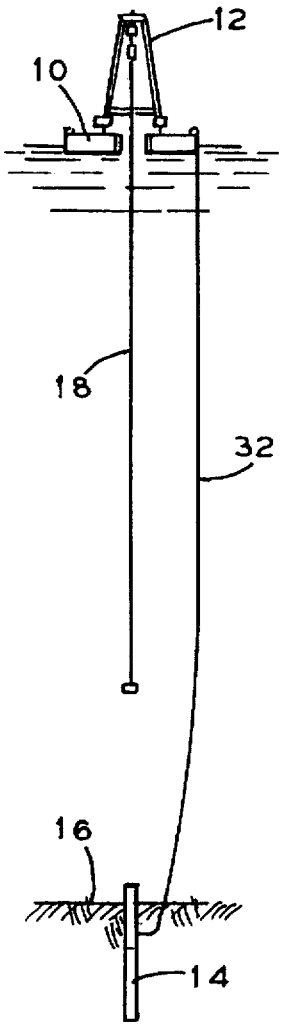
FIGS. 5–7 illustrate a method of removing a pile that has been driven into the sea floor.
Figure 6:
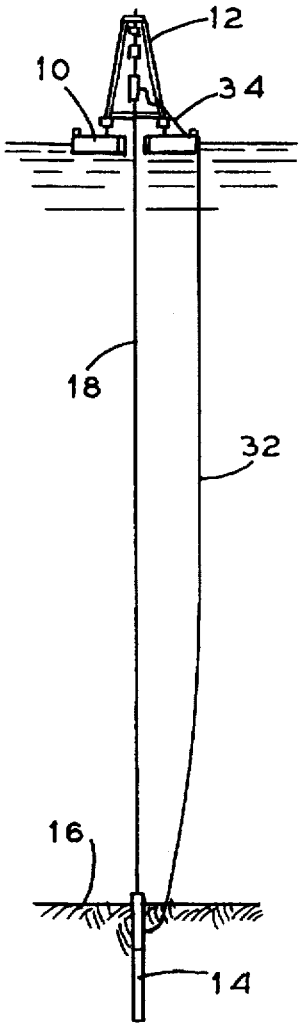
Figure 7:
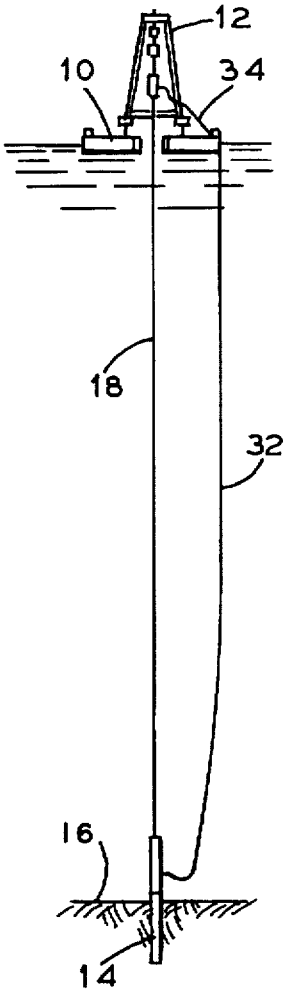

FIGS. 5–7 illustrate removal of the pile 14. The lowering pipe 18 is lowered and attached to the pile 14. Water is injected via line 34 into and through lowering pipe 18 and into the pile 14 through the pile head at a pressure higher than the ambient hydrostatic pressure. The high pressure water injection aids in overcoming the hydrostatic pressure on the outside of the pile head as well as soil friction with the pile. This reduces the force required to pull the pile 14 from the sea floor 16.

Figure 3:
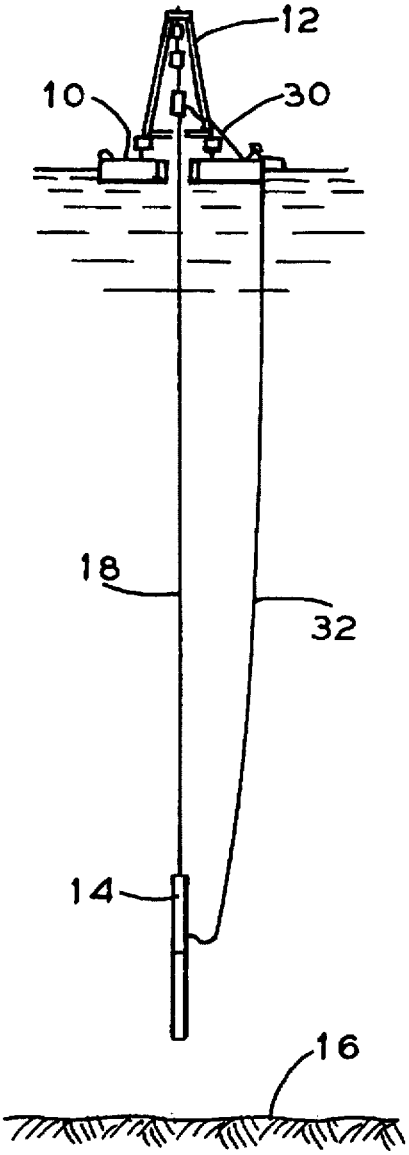
FIGS. 3 and 4 are elevation views that illustrate an alternate method of installing a pile.
Figure 4:
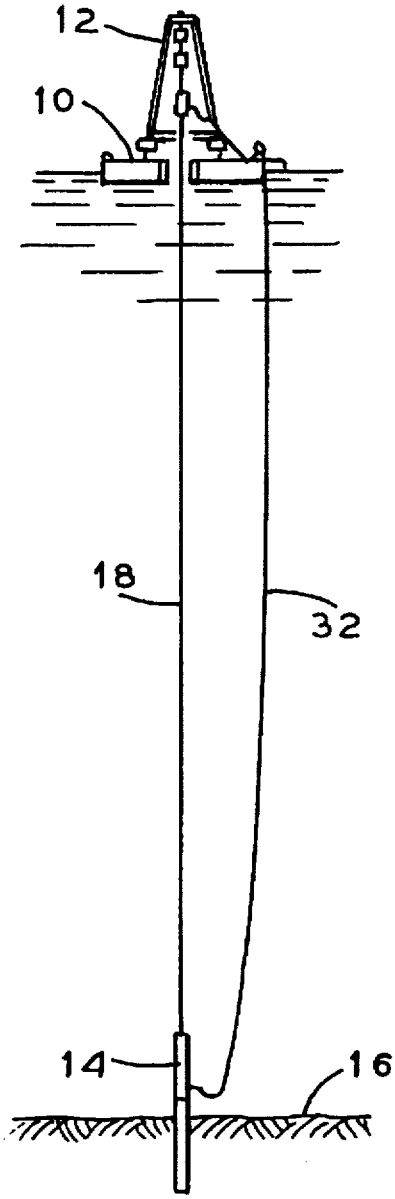

As illustrated in FIGS. 3–4, an alternate method of driving the pile 14 into the sea floor may be used wherein the pile 14 is lowered to a position where the lower end of the pile 14 is relatively close to but not in contact with the sea floor 16. The upper end of the lowering pipe 18 is closed and air is injected into the lowering pipe 18 through air injection line 30. This step may also be carried out during lowering of the pile 14 after a suitable depth has been reached. The injected air forces water from the lowering pipe 18 and the pile 14 out the bottom of the pile 14. The pile 14 is then lowered into contact with the sea floor. Air is then bled off through fluid line 28. The release of air from the pile 14 causes a decrease in buoyancy and results in a pressure differential. The greater external hydrostatic pressure of the water pushes the pile 14 into the sea floor. The bleeding of air from the pile 14 and lowering pipe 18 may be done at a steady rate or in steps where air is bled off intermittently. For the pile shown, the mooring line 32 is attached at a point below the top of the pile 14 and is carried below the surface of the sea floor 16 during installation of the pile 14.

Figure 8:
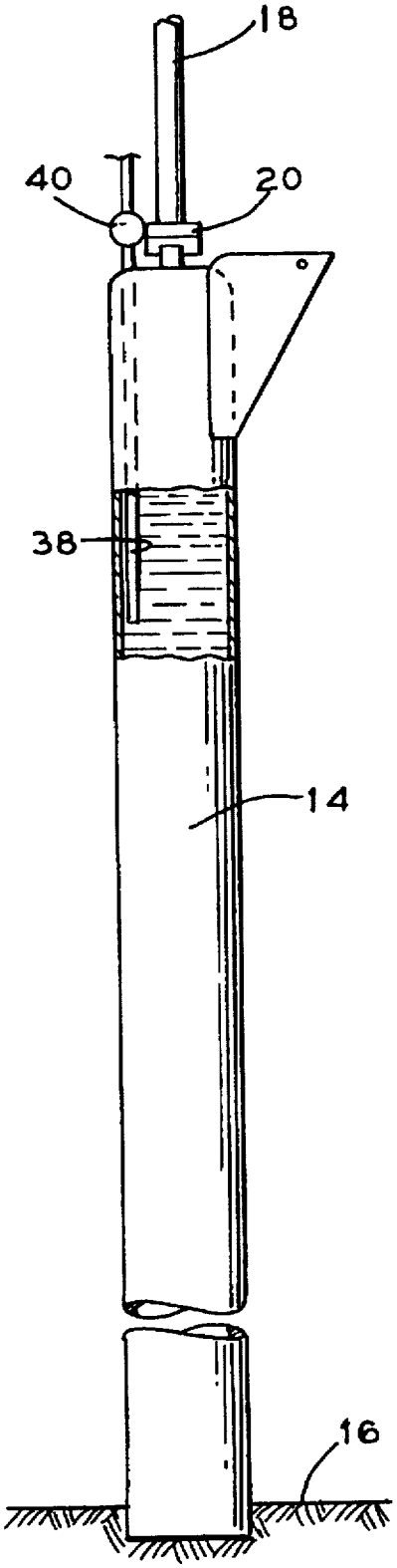
FIGS. 8–10 illustrate an alternate method of installing a pile.
Figure 9:
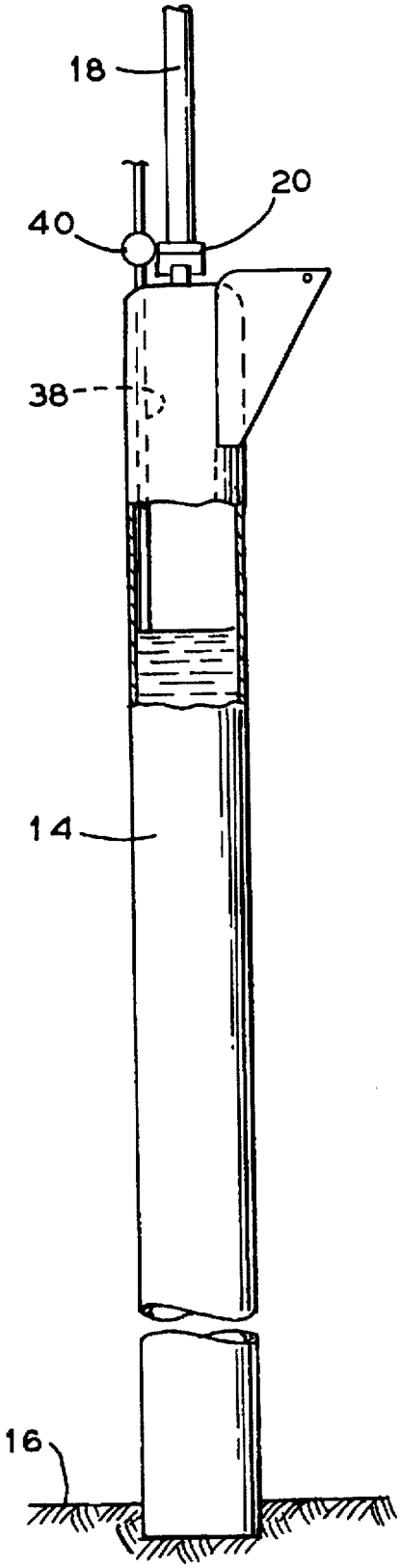
Figure 10:
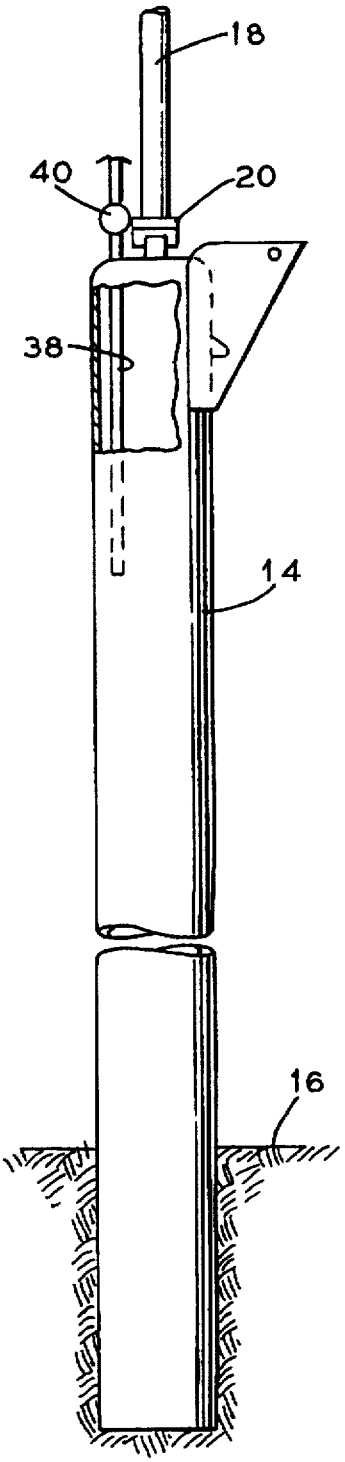

FIGS. 8–10 illustrate an alternate method of installing a pile into the sea floor in deep water. A pile 14 is provided that has a standpipe 38 extending out of the upper end of the pile 14. A check valve 40 is provided in stand pipe 38 to limit the direction of fluid flow from the inside of the pile 14 to the outside of the pile 14. Lowering pipe 18 is attached to the top of the pile 14 by means of the marine connector 20, which places the lowering pipe 18 and the pile 14 in fluid communication. The pile 14 floods with sea water as it is lowered to the sea floor 16. Once the pile 14 is in contact with the sea floor, air is injected into the pile 14 through the lowering pipe 18 and the pile 14. The air forces water in the pile 14 out through the stand pipe 38. When the water level falls below the lower end of the stand pipe 38, as seen in FIG. 9, the air being injected escapes through the stand pipe 38. At this time, the injection of air through the lowering pipe 18 is stopped. Air is then bled off through the lowering pipe 18. This creates a pressure differential where the greater hydrostatic pressure on the pile head forces the pile 14 into the sea floor as seen in FIG. 10. Once all the air has been bled off through the lowering pipe 18, the process is repeated until the pile 14 is driven into the sea floor 16 the desired depth. The lowering pipe 18 is then disconnected from the pile 14 and retrieved on the surface vessel.

The installation method works on the principle that the force required to push the pile into the sea floor is resisted by the force required to shear the soil. The driving force is the difference between the pressure on top of the pile head and the pressure beneath the pile head multiplied times the area of the pile head. The resisting force is approximately the total soil shear force required to shear the surface area of the pile, that is, the inside and outside surface areas of the pile. As an example, in the Gulf of Mexico this is approximately equal to ten pounds per square foot per foot of penetration. The formula shown below illustrates a means of roughly estimating the relationship between pile diameter, differential pressure on the head of the pile, soil shear gradient, and pile penetration.

$$L=\sqrt{\frac{\Delta PD}{4Sg}}$$

For this formula, L=pile penetration, ΔP=difference between pressure on the top of the pile head and beneath the pile head, D=diameter of pile, and Sg=shear gradient of the soil. The Penetration Force must equal the Restraining Force ($F_p=F_r$).

$F_p$=Differential pressure on the pile head times area of the pile head.

$F_r$=Average Shear resistance per unit area times the surface area of the inside and outside of the pile walls.

$$F_p=\Delta P\times\pi D^2/4$$

$$F_R=\frac{Sg\times L}{2}\times 2\pi D\times L$$

As a practical example, in the Gulf of Mexico, the bearing strength of the soil is equal to approximately eight to ten times the shear strength of the soil. Based on these soil properties, a pile with a twelve foot diameter can be pushed into the sea floor approximately one hundred fifty feet with a pile head differential pressure of one thousand pounds per square inch and will withstand an anchor line load of approximately three thousand kips.

Figure 11:
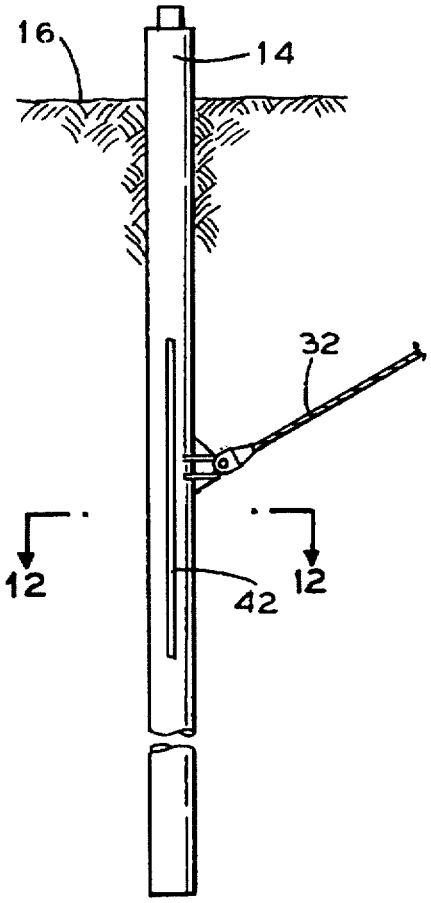
FIG. 11 is an elevation view of a piling driven in the sea floor.
Figure 12A:
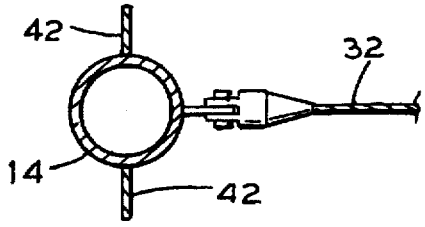
FIGS. 12A and 12B are views taken along lines 12—12 in FIG. 11.
Figure 12B:
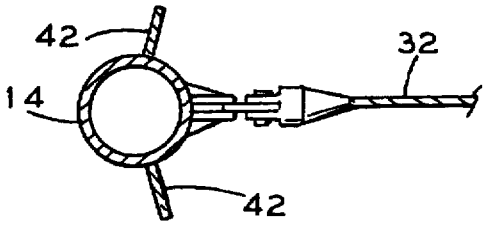

As seen in FIGS. 11–12B, the pile 14 may be provided with flukes 42 that extend outwardly from the outer diameter of the pile 14. The flukes 42 may be parallel to each other as seen in FIG. 12A or may extend at an angle in the direction of pull from the mooring line 32 as seen in FIG. 12B.

As seen in FIG. 2, for a pile 14 where the mooring line is to be attached to the upper end of the pile, a stabbing receptacle 44 may be provided to simplify installation of the mooring line after the pile 14 has been driven into the sea floor.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for driving a pile into the sea floor, comprising:

a. providing a surface vessel having air injection means and a derrick having means for raising and lowering pipe;

b. attaching the upper end of the pile to a lowering pipe such that the pile and lowering pipe are in fluid communication and using the derrick in conjunction with the lowering pipe to lower the pile toward the sea floor;

c. closing the upper end of the lowering pipe and injecting air into the lowering pipe to force water from the lowering pipe and pile before the lower end of the pile contacts the sea floor;

d. lowering the pile to the sea floor; and e. bleeding air from the upper end of the lowering pipe to create a pressure differential which pushes the pile into the sea floor.

2. A method for driving a pile into the sea floor, comprising:

a. providing a surface vessel having air injection means and a derrick having means for raising and lowering pipe;

b. providing a pile having a stand pipe through the upper end of the pile;

c. attaching the upper end of the pile to a lowering pipe such that the pile and lowering pipe are in fluid communication and lowering the pile to the sea floor;

d. injecting air into the pile through the lowering pipe, forcing water in the pile out through the stand pipe; and e. bleeding air in the pile out through the lowering pipe to create a pressure differential that pushes the pile into the sea floor.

* * * * *